US008547027B2

(12) United States Patent
Akiyama et al.

(10) Patent No.: US 8,547,027 B2
(45) Date of Patent: Oct. 1, 2013

(54) LED DRIVE CIRCUIT

(75) Inventors: Takashi Akiyama, Sayama (JP); Rintaro Takahashi, Tokorozawa (JP); Hisashi Fukasawa, Yamanashi (JP); Ryoichi Watanabe, Fujiyoshida (JP)

(73) Assignees: Citizen Holdings Co., Ltd., Tokyo (JP); Citizen Electronics Co., Ltd., Yamanashi (JP)

( * ) Notice: Subject to any disclaimer, the term of this patent is extended or adjusted under 35 U.S.C. 154(b) by 100 days.

(21) Appl. No.: 13/237,572

(22) Filed: Sep. 20, 2011

(65) Prior Publication Data

US 2012/0068616 A1 Mar. 22, 2012

(30) Foreign Application Priority Data

Sep. 22, 2010 (JP) ..... 2010-211970

(51) Int. Cl.
*H05B 37/00* (2006.01)

(52) U.S. Cl.
USPC ..... 315/200 R; 315/224; 315/360

(58) Field of Classification Search
USPC ..... 315/185 R, 187, 193, 200 R, 207, 315/224, 291, 300, 301, 360
See application file for complete search history.

(56) References Cited

U.S. PATENT DOCUMENTS

| | | | | |
|---|---|---|---|---|
| 2005/0213352 | A1* | 9/2005 | Lys | 363/17 |
| 2008/0054817 | A1* | 3/2008 | Kao et al. | 315/209 R |
| 2010/0270941 | A1* | 10/2010 | Hui | 315/291 |
| 2011/0133662 | A1* | 6/2011 | Yan et al. | 315/224 |
| 2011/0254467 | A1* | 10/2011 | Chiang et al. | 315/297 |
| 2012/0139431 | A1* | 6/2012 | Thompson et al. | 315/200 R |

FOREIGN PATENT DOCUMENTS

| | | |
|---|---|---|
| JP | 56-29900 | 3/1981 |
| JP | 07-273371 | 10/1995 |
| JP | 2006-073637 | 3/2006 |
| JP | 2007-123562 | 5/2007 |

* cited by examiner

*Primary Examiner* — Tung X Le
(74) *Attorney, Agent, or Firm* — Finnegan, Henderson, Farabow, Garrett & Dunner, L.L.P.

(57) ABSTRACT

An object of the invention is to provide an LED drive circuit that can suppress the generation of harmonic noise. The LED drive circuit includes a rectifying circuit an LED array, and a current supply circuit which includes a capacitor and a time constant adjusting element, wherein the discharge time constant of the current supply circuit is set longer than the charge time constant of the current supply circuit, and wherein during a period of time when the magnitude of AC commercial power supply voltage is larger than the light emission threshold of the LED array, current to the light-emitting circuit is supplied mostly from the rectifying circuit, and during a period of time when the magnitude of AC commercial power supply voltage is not larger than the light emission threshold of the LED array, current to the light-emitting circuit is supplied from the current supply circuit.

6 Claims, 7 Drawing Sheets

LED DRIVE CIRCUIT

This application is a new U.S. patent application that claims benefit of JP 2010-211970, filed on Sep. 22, 2010, the entire content of JP 2010-211970 is hereby incorporated by reference.

FIELD OF THE INVENTION

The present invention relates to an LED drive circuit, and more particularly to an LED drive circuit for driving LEDs to emit light by using an AC commercial power supply.

DESCRIPTION OF THE RELATED ART

It is known to provide an LED drive circuit which rectifies AC power supplied from an AC commercial power supply and drives an LED (light-emitting diode) array by its output.

Of the various types of LED drive circuits, a circuit is known that directly drives an LED array by a pulsating DC output from a diode bridge circuit (for example, patent document 1). FIG. 6 in patent document 1 shows a light-emitting diode drive circuit 80 which comprises a plurality of light-emitting diodes devices 18, an input terminal 12 for connecting to an AC commercial power supply, a bridge diode device 14, resistors R1, R2, and R3, and a Zener diode 82. In the figure, an output terminal of the bridge diode device 14 is connected via the resistor R3 to the LED array formed from the light-emitting diode devices 18. Patent document 1 is intended to solve the temperature-rise problem associated with the resistors R1, R2, and R3 and the Zener diode 82 in the light-emitting diode drive circuit 80 shown in FIG. 6, and provides a light-emitting diode drive circuit 10 which includes a capacitor 16 by which the voltage of an AC power supply for driving a light-emitting diode unit 20 is caused to drop (see FIG. 1).

As shown in FIGS. 1 and 6 in patent document 1, when driving the LED array by the pulsating DC output from the diode bridge circuit, there occurs an OFF period during which the LED array turns off. That is, when the number of LEDs in the LED array is denoted by n, and the forward voltage drop of each LED is denoted by Vf(V), if the pulsating DC voltage becomes smaller than n×Vf(V), the LED array turns off. Since the OFF period not only introduces flicker but reduces the brightness of light, it has been desired to shorten the OFF period.

To shorten the OFF period, there is proposed a method that smoothes the pulsating DC by a capacitor (for example, see patent document 2). FIG. 1 in patent document 2 shows a light-emitting device operation control apparatus which smoothes the output of a half-wave rectifier circuit 11 by a smoothing capacitor 12 and drives a plurality of LEDs 20 to emit light by using the thus smoothed voltage. In the circuit shown in FIG. 1 in patent document 2, if a small amount of ripple remains in the smoothed voltage, the current flowing to the LED array (the plurality of LEDs 20) is regulated at a constant level by using a shunt regulator 15 and a bipolar transistor 16 (see FIG. 2 and paragraph [0024]). However, the light-emitting device operation control apparatus disclosed in patent document 2 has had the problem that a large-capacitance capacitor is required if a sufficient current is to be flown to the LED array.

A discharge lamp lighting apparatus is known that permits the use of a small-capacitance capacitor instead of a large-capacitance smoothing capacitor (for example, refer to patent document 3). The discharge lamp lighting apparatus comprises an AC power supply 1, a rectifier circuit 2, an inverter 4, and a discharge lamp 5 as the load, and includes, between the rectifier circuit 2 and the inverter 4, a capacitor 7 and a charge/discharge circuit 6 having a switch device 9 and a diode 8.

The capacitor 7 is charged by the charge/discharge circuit 6, and the charged state is thereafter maintained for a prescribed period of time by the action of the diode 8. Since the diode 8 and the switch device 9 are disposed in the charge path and the discharge path of the capacitor 7, respectively, the OFF period of the discharge lamp 5 can be shortened by causing the switch device to conduct at appropriate times and thereby permitting the use of the small-capacitance capacitor 7.

It is known to provide, as another method for shortening the OFF period, an LED drive circuit that changes the number of stages to turn on in the LED array as the output voltage of the diode bridge circuit changes (for example, refer to patent document 4). In patent document 4, the LED array is divided into four groups (group A (two LEDs), group B (four LEDs), group C (eight LEDs), and group D (16 LEDs)). The LED drive circuit disclosed in patent document 4 performs control so that when the output voltage of the diode bridge circuit is low, the voltage is applied only to group A and, as the voltage increases, the number of groups to which the voltage is applied is increased, such as groups A and B and then groups A to C; when the voltage is highest, the voltage is applied to all the four groups.

Patent document 1: JPH07-273371-A (FIGS. 1 and 6)
Patent document 2: JP2006-73637-A (FIGS. 1 and 2, and paragraph [0024])
Patent document 3: JPS56-29900-U (FIG. 4)
Patent document 4: JP2007-123562-A (FIG. 1)

SUMMARY OF THE INVENTION

If there is an appreciable OFF period as in the case of patent document 1, not only the introduction of flicker and the reduction of brightness but also a phenomenon referred to as "motion breaks" occurs that causes a high-speed moving object to appear to be moving discontinuously.

On the other hand, in the case of patent document 2 which attempts to eliminate the OFF period by smoothing the output of the rectifier circuit, if the brightness is to be increased by flowing a sufficient current to the LED array, there arises a need to use an electrolytic capacitor having a large capacitance and high breakdown voltage. Such an electrolytic capacitor not only is large in size, but also has the disadvantage that its lifetime becomes extremely short in a high-temperature environment such as in lighting equipment.

In the case of the circuit disclosed in patent document 3, harmonic noise occurs at the moment that the switch device conducts. The harmonic noise propagates to the commercial power supply side and may cause malfunction of other electrical appliances connected to it. There is therefore a need to add a special component, etc., to provide protection against harmonic noise, and this can lead to an increase in the size as well as the cost of the product.

Further, if it is attempted to shorten the OFF period by changing the number of stages to turn on in the LED array in accordance with the value of the rectified voltage, as in the method disclosed in patent document 4, there arises a need to meticulously control the number of stages to turn on.

An object of the present invention is to provide an LED drive circuit that can solve the above-enumerated problems.

Another object of the present invention is to provide an LED drive circuit for driving an LED array by rectifying AC power, that can shorten or eliminate the OFF period while permitting the use of a small-capacitance capacitor.

A further object of the present invention is to provide an LED drive circuit that can suppress the generation of harmonic noise.

The LED drive circuit includes a rectifying circuit for rectifying AC commercial power, a light-emitting circuit which includes an LED array, and a current supply circuit which includes a capacitor and a time constant adjusting element, wherein the discharge time constant of the current supply circuit is set longer than the charge time constant of the current supply circuit, and the capacitor is charged by an output of the rectifying circuit, and wherein during a period of time when the magnitude of AC commercial power supply voltage is larger than the light emission threshold of the LED array, current to the light-emitting circuit is supplied mostly from the rectifying circuit, and during a period of time when the magnitude of AC commercial power supply voltage is not larger than the light emission threshold of the LED array, current to the light-emitting circuit is supplied from the current supply circuit.

Preferably, in the LED drive circuit, the time constant adjusting element is a resistor.

Preferably, in the LED drive circuit, the time constant adjusting element is a current regulating diode.

Preferably, in the LED drive circuit, the current supply circuit further includes a switch device connected in series with the capacitor.

Preferably, the LED drive circuit further comprises a control circuit which changes the number of stages to turn on in the LED array in accordance with the AC commercial power supply voltage.

Preferably, in the LED drive circuit, the light-emitting circuit includes a current limiting circuit.

When the magnitude of the AC commercial power supply voltage is larger than the threshold of the LED array, since a large amount of current flows to the LED array via the rectifying circuit, the current supply circuit does not substantially contribute to the light emitting operation of the LED array. When the magnitude of the AC commercial power supply voltage drops close to the threshold of the LED array, the rectifying circuit is cut off, and the current supply circuit begins to supply current to the LED array. In this case, the current is limited to a small value by the time constant adjusting element, and the LED array is caused to emit light with this small current. In this way, in the LED drive circuit, since the LED array is caused to emit light with the small current during the period when the AC commercial power supply voltage is not larger than the threshold of the LED array, the OFF period can be shortened or eliminated while permitting the use of a small-capacitance capacitor in the current supply circuit.

Furthermore, in the LED drive circuit, since the current supplied from the capacitor to the LED array is limited to a small value by the time constant adjusting element, harmonic noise does not occur.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

LED drive circuits will be described with reference to the drawings. It should, however, be understood that the present invention is not limited to the drawings or the specific embodiments described herein.

Figure 1:
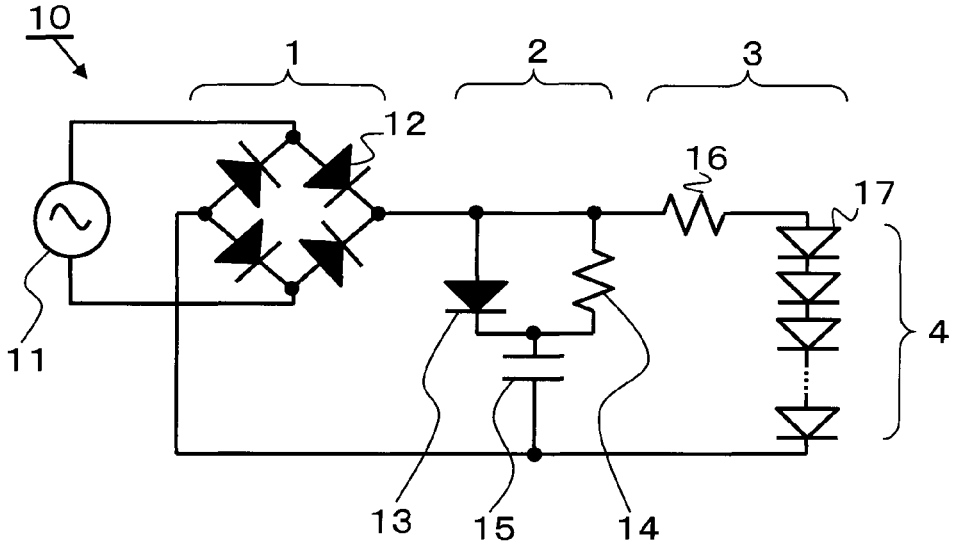
FIG. 1 is a circuit diagram of an LED drive circuit 10.
Figure 2A:
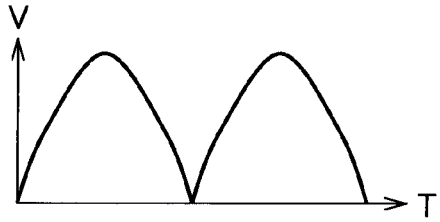
FIG. 2 is a diagram for explaining the operation of the LED drive circuit 10 shown in FIG. 1.
Figure 2B:
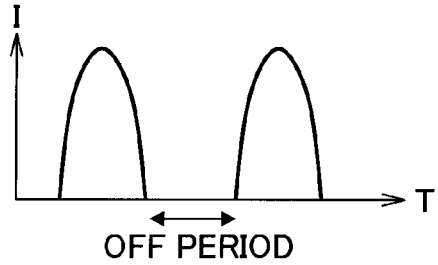
Figure 2C:
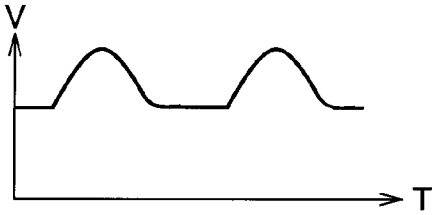
Figure 2D:
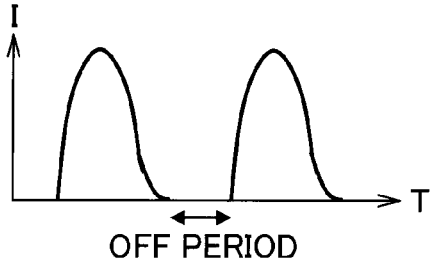
Figure 2E:
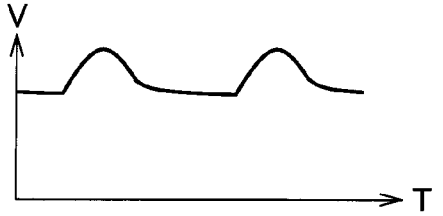
Figure 2F:
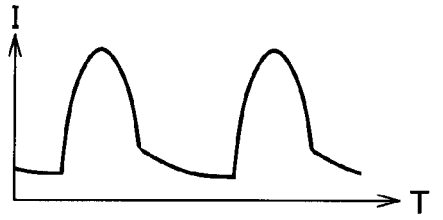

FIG. 1 is a circuit diagram of an LED drive circuit 10.

The LED drive circuit 10 comprises a diode bridge circuit 1 (rectifying circuit), a current supply circuit 2, and a light-emitting circuit 3.

The diode bridge circuit 1 (rectifying circuit) is constructed with four silicon diodes 12 and connected to an AC commercial power supply 11.

The current supply circuit 2 includes a silicon diode 13, a resistor 14 (time constant adjusting element), and a capacitor 15. The anode of the silicon diode 13 and one end of the resistor 14 are connected to an output terminal of the diode bridge circuit 1, while the cathode of the silicon diode 13 and the other end of the resistor 14 are connected to one end of the capacitor 15.

The light-emitting circuit 3 includes a resistor 16 (a current limiting circuit, which may be replaced by a current regulating diode or a current regulating circuit) and an LED array 4 formed from a series connection of LEDs 17. One end of the resistor 16 is connected to the output terminal of the diode bridge circuit 1, and the other end is connected to the positive side of the LED array 4. The negative side (output side) of the LED array 4 and the other end of the capacitor 15 are connected to a terminal that also serves as the anode of the diode bridge circuit 1.

FIG. 2 is a diagram for explaining the operation of the LED drive circuit 10 shown in FIG. 1.

FIG. 2(*a*) shows the drive voltage to the light-emitting circuit 3 when the LED drive circuit 10 is not equipped with the current supply circuit 2. In this case, the drive voltage is a pulsating DC (full-wave rectification) produced by rectifying the output of the AC commercial power supply 11.

FIG. 2(*b*) shows the current that flows through the light-emitting circuit 3 when the LED drive circuit 10 is not equipped with the current supply circuit 2. Since the LED array 4 has a threshold value, when the drive voltage exceeds the threshold value, the current increases rapidly. During the period when the drive voltage is higher than the threshold value, the current is limited by the action of the current-limiting resistor 16. Next, when the drive voltage drops to the threshold value of the LED array 4, the current decreases rapidly, and during the period when the drive voltage is smaller than the threshold value, no current flows through the LED array 4 (OFF period). When the number of LEDs 17 in the LED array 4 is denoted by n, and the forward voltage drop of each LED 17 is denoted by Vf(V), the threshold value of the LED array 4 is given as n×Vf(V). Suppose, for example, that the rms value of the AC commercial power supply 11 is 100 V, that Vf is 3 V, and that 33 LEDs 17 are connected in series; then, the threshold value of the LED array 4 is 99V, and the OFF period accounts for about 50% of the total time.

FIG. 2(*c*) shows the drive voltage to the light-emitting circuit 3 when the LED drive circuit 10 is equipped with a small-capacitance smoothing capacitor in place of the current supply circuit 2. This corresponds, for example, to the case where the resistance of the resistor 14 is reduced to 0Ω (short-circuited) and the capacitor 15 is replaced by a smoothing capacitor in the LED drive circuit 10 shown in FIG. 1. In this case, the drive voltage contains large ripples. During the period when the voltage of the AC commercial power supply 11 is not smaller than the threshold value of the LED array 4 (hereinafter, the amplitude of the voltage (not shown) of the AC commercial power supply 11 is given in terms of an absolute value and is assumed to have the same value as that of the pulsating DC shown in FIG. 2(*a*)), the drive voltage is a pulsating DC equivalent to (a portion of) that shown in FIG. 2(*a*). When the voltage of the AC commercial power supply 11 drops and comes close to the threshold value of the LED array 4, the drive voltage briefly describes a discharge curve and thereafter stays constant.

In the above case, during the period when the voltage of the AC commercial power supply 11 is higher than the threshold value of the LED array 4, a large amount of current flows to the light-emitting circuit 3; as a result, the smoothing capacitor having a small capacitance may not be able to smooth the drive voltage to be supplied to the light-emitting circuit 3. When the voltage of the AC commercial power supply 11 drops close to the threshold value of the LED array 4, and the diode bridge circuit 1 is cut off, the smoothing capacitor begins to supply current to the light-emitting circuit 3. However, the voltage across the smoothing capacitor (the drive voltage to be supplied to the light-emitting circuit 3) drops to or below the threshold value of the LED array 4 in a short time, because the capacitance of the smoothing capacitor is small. As a result, the LED array 4 is also cut off, and the drive voltage is maintained at a constant value until the voltage of the AC commercial power supply 11 again increases above the threshold value of the LED array 4.

FIG. 2(*d*) shows the current that flows through the light-emitting circuit 3 when the LED drive circuit 10 of FIG. 1 is equipped with a small-capacitance smoothing capacitor in place of the current supply circuit 2. In this case, when the voltage of the AC commercial power supply 11 drops and comes close to the threshold value of the LED array 4, current flows from the smoothing capacitor to the LED array only for a short period. After that, no current flows until the voltage of the AC commercial power supply 11 again increases above the threshold value of the LED array 4. This period during which no current flows is the OFF period, but the OFF period in this case improves over the OFF period in FIG. 2(*b*) only by an amount equal to that short period.

FIG. 2(*e*) shows the drive voltage to the light-emitting circuit 3 in the LED drive circuit 10 shown in FIG. 1. This drive current also contains large ripples. During the period when the voltage of the AC commercial power supply 11 is higher than the threshold value of the LED array 4, the drive voltage is a pulsating DC equivalent to (a portion of) that shown in FIG. 2(*a*). During the period when the voltage of the AC commercial power supply 11 is smaller than the threshold value of the LED array 4, the drive voltage describes a discharge curve.

FIG. 2(*f*) shows the current that flows through the light-emitting circuit 3 in the LED drive circuit 10 shown in FIG. 1 for the case corresponding to that shown in FIG. 2(*e*). When the voltage of the AC commercial power supply 11 drops and comes close to the threshold value of the LED array 4, the current supply circuit 2 begins to flow current to the light-emitting circuit 3. During the period when the voltage of the AC commercial power supply 11 is smaller than the threshold value of the LED array 4, the current is held to a small value because the current is limited by the resistor 14. At this time, the LED array 4 turns on with the small current supplied from the current supply circuit 2.

During the first half of the period when the voltage of the AC commercial power supply 11 is higher than the threshold value of the LED array 4, i.e., during the period when the voltage is increasing, the diode bridge 1 supplies current to the current supply circuit 2 and the light-emitting circuit 3. On the other hand, during the second half of the period when the voltage of the AC commercial power supply 11 is higher than the threshold value of the LED array 4, that is, during the period when the voltage is decreasing, the diode bridge 1 and the current supply circuit 2 supply current to the light-emitting circuit 3. However, during this period, while the diode bridge 1 supplies a large amount of current to the light-emitting circuit 3, the current supply circuit 2 is only able to supply a trace amount of current compared with the diode bridge 1 because of the presence of the resistor 14. That is, during the period when the voltage of the AC commercial power supply 11 is higher than the threshold value of the LED array 4, the diode bridge 1 in effect supplies the necessary current to the light-emitting circuit 3. On the other hand, during the period when the voltage of the AC commercial power supply 11 is not higher than the threshold value of the LED array 4, since the output voltage of the current supply circuit 2 becomes higher than the voltage of the AC commercial power supply 11, the diode bridge circuit 1 is cut off, and the current supply circuit 2 supplies current to the light-emitting circuit 3. That is, during this period, the current supply circuit 2 slowly discharges the charge stored on the capacitor 15 through the resistor 15, and thus the drive voltage gradually decreases.

In the LED drive circuit 10 shown in FIG. 1, the charge time constant of the capacitor 15 in the current supply circuit 2 is set shorter than the discharge time constant. As a result, during the period when the voltage of the AC commercial power supply 11 is higher than the threshold value of the LED array 4, current to the light-emitting circuit 3 is supplied mostly from the diode bridge circuit 1. On the other hand, during the period when the voltage of the AC commercial power supply 11 is not higher than the threshold value of the LED array 4, the current supply circuit 2 supplies current to the light-emitting circuit 3.

To eliminate the OFF period, the time constant which is determined by the product of the resistor 14 and the capacitor 15 is set approximately equal to the OFF period. For example, when the pulsation period is 10 ms (frequency: 100 Hz), and the OFF period is about 5 ms, the resistor 14 is set to 1 kΩ and the capacitor 15 to 4 μF (the time constant is 4 ms). Since the current supplied from the current supply circuit 2 is restricted by the resistor 14, the capacitance of the capacitor 15 can be made small, so that a ceramic capacitor having a long lifetime can be used as the capacitor 15.

In the LED drive circuit 10 shown in FIG. 1, sharp changes as may be contained in the current value do not occur, as illustrated in FIG. 2(*f*). As a result, harmonic noise does not occur in the LED drive circuit 10 shown in FIG. 1.

In the LED drive circuit 10, the discharge time constant of the current supply circuit 2 is set longer than the charge time constant. The charge time constant is determined by the product of the internal resistance of the diode 13 and the capacitance of the capacitor 15. The discharge time constant is determined by the product of the resistance of the resistor 14 and the capacitance of the capacitor 15. Since the discharge of the capacitor 15 after the cutoff of the diode bridge circuit 1 is affected not only by the resistor 14 but also by the resistor 16 and the resistive component of the diode array 4, the resistance of the resistor 14 is appropriately determined by simulation or experiment.

When the discharge time constant is set longer than the charge time constant, the voltage on the capacitor 15 at the time that the diode bridge circuit 1 is cut off is higher than the output voltage of the AC commercial power supply 11. After the diode bridge circuit 1 is cut off, the current supply circuit 2 discharges the voltage slowly because the discharge time constant is long. If the discharge time constant were set shorter, the discharge would occur rapidly after the cutoff of the diode bridge circuit 1, and the current value would quickly drop to zero. Such a rapid change in current would result in the generation of harmonic noise. In contrast, in the LED drive circuit 10, since the current changes slowly after the cutoff of the diode bridge circuit 1, it becomes possible to suppress the generation of harmonic noise.

Figure 3:
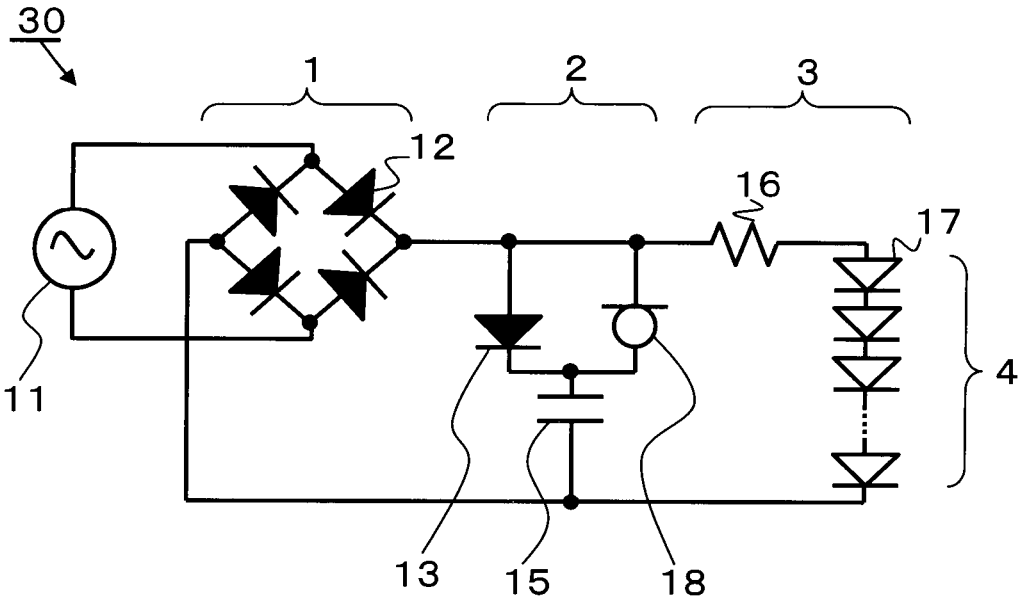
FIG. 3 is a circuit diagram of an alternative LED drive circuit 30.

FIG. 3 is a circuit diagram of an alternative LED drive circuit 30.

The only difference between the alternative LED drive circuit 30 shown in FIG. 3 and the LED drive circuit 10 shown in FIG. 1 is that the resistance 14 provided in the LED drive circuit 10 shown in FIG. 1 is replaced by a current regulating diode 18 (time constant adjusting element).

Figure 4:
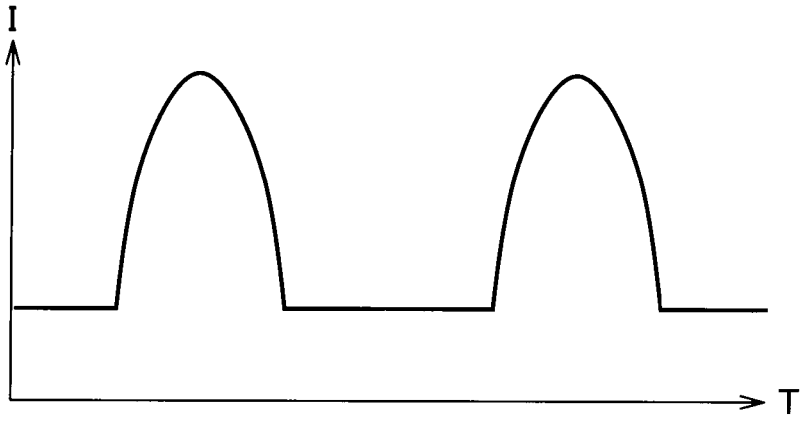
FIG. 4 is a diagram for explaining the operation of the LED drive circuit 30 shown in FIG. 3.

FIG. 4 is a diagram for explaining the operation of the alternative LED drive circuit 30.

In the LED drive circuit 30 shown in FIG. 3, the drive voltage to the light-emitting circuit 3 is the same as that shown in FIG. 2(*e*), and will not be shown here. The drive voltage to the light-emitting circuit 3 when the LED drive circuit 30 is not equipped with the current supply circuit 2 is the same as that shown in FIG. 2(*a*), and the current that flows through the light-emitting circuit 3 at that time is the same as that shown in FIG. 2(*b*).

FIG. 4 corresponds to FIG. 2(*f*) and shows the current that flows through the light-emitting circuit 3 in the LED drive circuit 30. During the period when the voltage of the AC commercial power supply 11 is not higher than the threshold value of the LED array 4, the LED array 4 turns on with the current supplied from the current supply circuit 2. During this period, the current is maintained constant by means of the current regulating diode 18. By restricting the current that can flow through the current regulating diode 18, the capacitance of the capacitor 15 can be made small. When the period that the voltage of the AC commercial power supply 11 is not higher than the threshold value of the LED array 4 is about 5 ms, and the capacitance of the capacitor 15 is 4 μF, as in the case of the LED drive circuit 10 shown in FIG. 1, the change in drive voltage during this period can be held to about 1.3 V when the LED array 4 is driven at 1 mA.

In the LED drive circuit 30 shown in FIG. 3, sharp changes as may be contained in the current value do not occur, as illustrated in FIG. 4. As a result, harmonic noise does not occur in the LED drive circuit 30 shown in FIG. 3.

In the LED drive circuit 30 also, the discharge time constant of the current supply circuit 2 is set longer than the charge time constant. The charge time constant is determined by the product of the internal resistance of the diode 13 and the capacitance of the capacitor 15. The discharge time constant T can be expressed as $T=C\cdot\Delta V/I$, where $\Delta V$ is the difference between the threshold voltage of the diode array 4 and the voltage on the capacitor 15 at the time that the diode bridge circuit 1 is cut off, C is the capacitance of the capacitor 15, and I is the current that flows through the current regulating diode 18.

Figure 5:
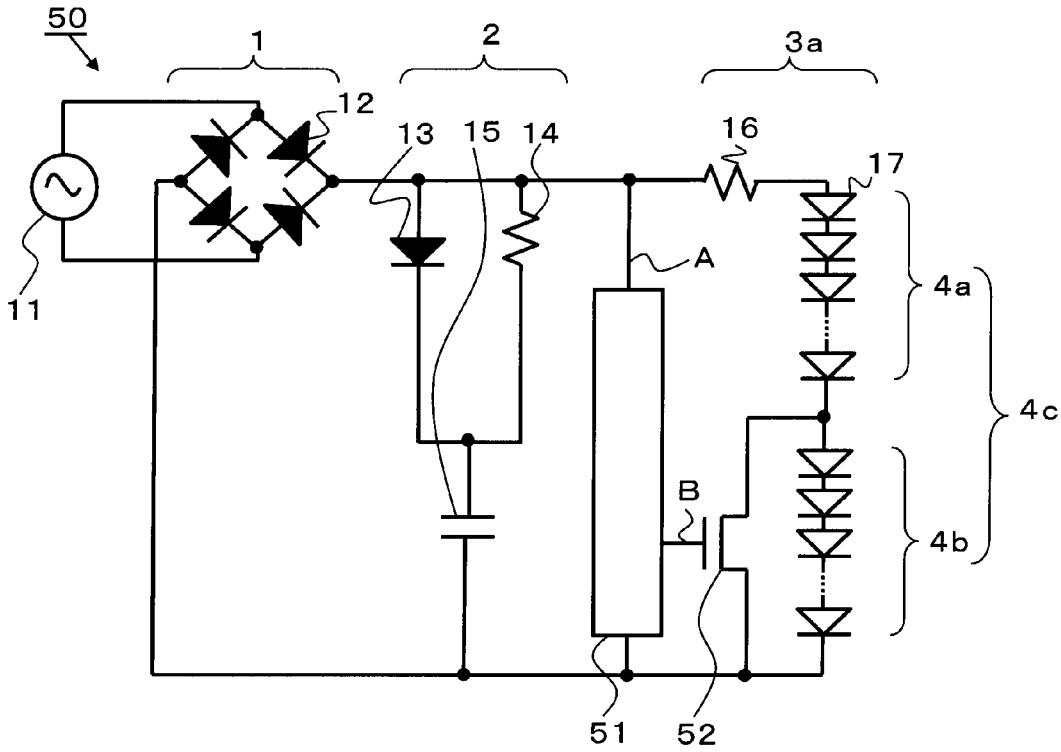
FIG. 5 is a circuit diagram of a further alternative LED drive circuit 50.
Figure 6A:
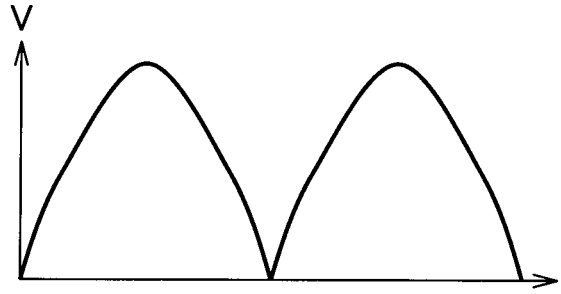
FIG. 6 is a diagram for explaining the operation of the LED drive circuit 50 shown in FIG. 5.
Figure 6B:
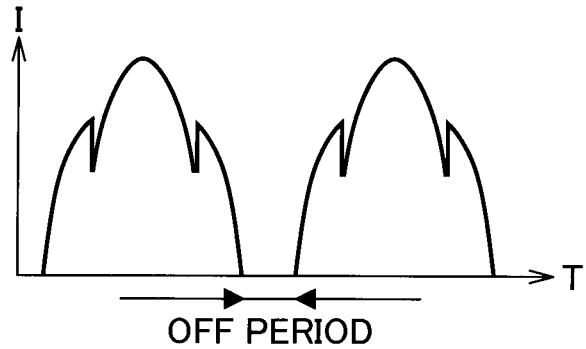
Figure 6C:
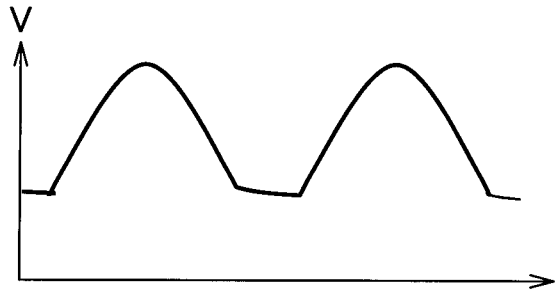
Figure 6D:
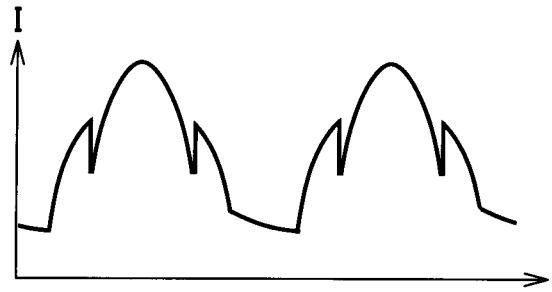

FIG. 5 is a circuit diagram of a further alternative LED drive circuit 50.

In the LED drive circuit 50, the number of stages to be connected in series in the LED array 4*c* in the light-emitting circuit 3*a* is changed in accordance with the drive voltage. The LED drive circuit 50 includes a control circuit 51 in addition to the current supply circuit 2. The control circuit 51 monitors the drive voltage (at terminal A) being supplied to the light-emitting circuit 3*a*, and when the drive voltage to the light-emitting circuit 3*a* drops and comes close to the threshold value of the LED array 4*c*, the gate electrode (terminal B) of an FET 52 (N-type MOS-FET) is set to a high level (the drive voltage (terminal A)), and the FET 52 is thus turned on. As a result, the LED array 4*b* turns off, and only the LED array 4*a* remains ON. The control circuit 51 that operates in this manner comprises a ladder resistor circuit, a comparator, etc.

FIG. 6 is a diagram for explaining the operation of the LED drive circuit 50.

FIG. 6(*a*) shows the drive voltage to the light-emitting circuit 3*a* when the LED drive circuit 50 is not equipped with the current supply circuit 2. The drive voltage here is a pulsating DC (full-wave rectification) produced by rectifying the output of the AC commercial power supply 11.

FIG. 6(*b*) shows the current that flows through the light-emitting circuit 3*a* when the LED drive circuit 50 is not equipped with the current supply circuit 2. As illustrated in FIG. 6(*b*), when the voltage of the AC commercial power supply 11 exceeds the threshold value of the LED array 4*a*, the current increases rapidly. When the voltage of the AC commercial power supply 11 exceeds the threshold value of the LED array 4*c*, the FET 52 turns off, and the current thus flows from the diode array 4*a* into the diode array 4*b*. As a result, the current decreases temporarily, and then begins to increase again. When the voltage of the AC commercial power supply 11 drops and comes close to the threshold value of the LED array 4*c*, the FET 52 turns on, and the current thus flows from the diode array 4*a* into the FET 52. As a result, the current increases temporarily, and then decreases rapidly. When the voltage of the AC commercial power supply 11 drops to or below the threshold value of the LED array 4*a*, the current does not flow. The period that the current does not flow is the OFF period. When a comparison is made between FIG. 6(*b*) and FIG. 2(*b*), it is seen that the OFF period in FIG. 6(*b*) is shorter than that shown in FIG. 2(*b*).

FIG. 6(*c*) shows the drive voltage to the light-emitting circuit 3*a* in the LED drive circuit 50. During the period when the voltage of the AC commercial power supply 11 is higher than the threshold value of the LED array 4*a*, the waveform is the same as that of a portion of the pulsating DC shown in FIG. 6(*a*), and during the period when the voltage of the AC commercial power supply 11 is not higher than the threshold value of the LED array 4*a*, the drive voltage describes a discharge curve.

FIG. 6(*d*) shows the current that flows through the light-emitting circuit 3*a* in the LED drive circuit 50. When the voltage of the AC commercial power supply 11 drops and becomes generally lower than the threshold value of the LED array 4*a*, a small amount of current is supplied from the current supply circuit 2 to drive the LED array 4*a*.

When the number of stages to be connected in series in the LED arrays is thus changed, the current value changes, and harmonic noise occurs. However, since the LED drive circuit 50 performs control so that the current value does not suddenly drop to zero in the current supply circuit 2, as shown in FIG. 6(*d*), harmonic noise does not increase, but rather, it decreases.

In the LED drive circuit 50, the discharge time constant of the current supply circuit 2 is set longer than the charge time constant. The charge time constant is determined by the product of the internal resistance of the diode 13 and the capacitance of the capacitor 15. The discharge time constant is determined by the product of the resistance of the resistor 14 and the capacitance of the capacitor 15. Since the discharge of the capacitor 15 after the cutoff of the diode bridge circuit 1 is affected not only by the resistor 14 but also by the resistor 16 and the resistive component of the diode array 4, the resistance of the resistor 14 is appropriately determined by simulation or experiment. Further, since the OFF period in the LED drive circuit 50 is shorter than the OFF period in the LED drive circuit 10, the discharge time constant in the LED drive circuit 50 is set shorter than discharge time constant in the LED drive circuit 10.

Figure 7:
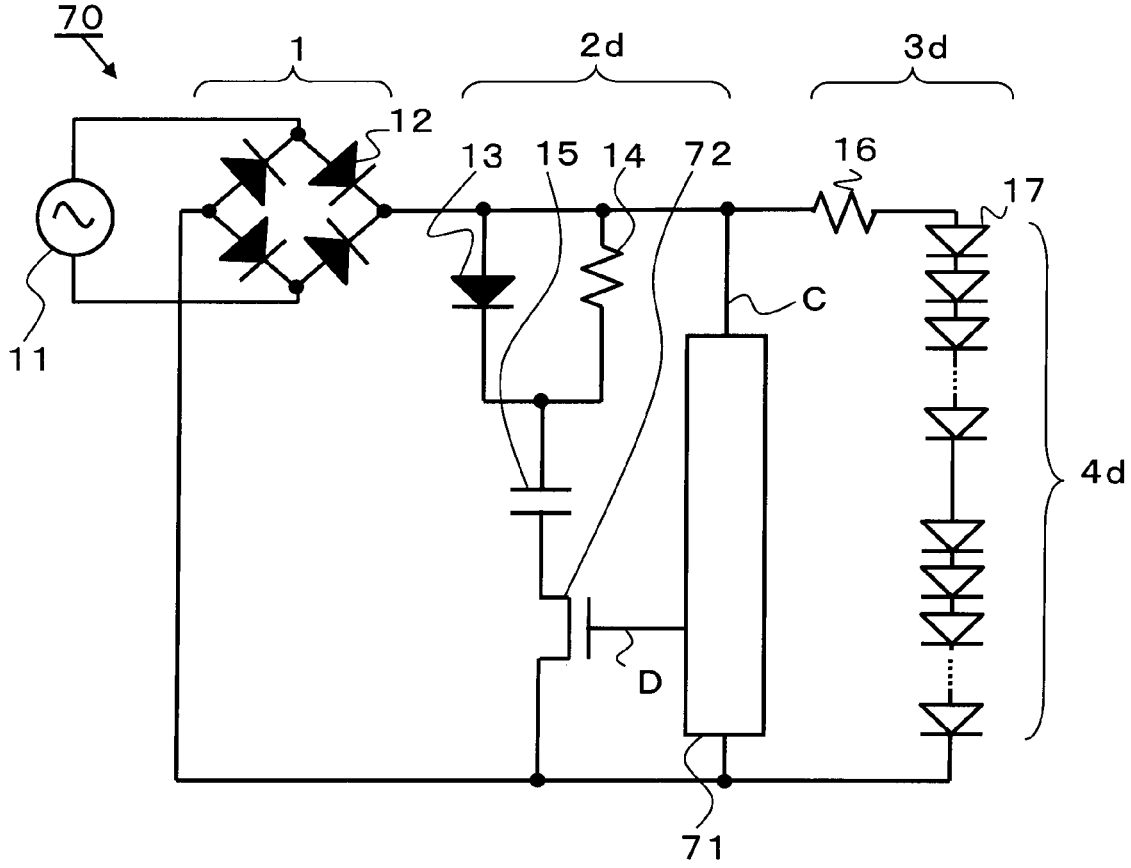
FIG. 7 is a circuit diagram of a still further alternative LED drive circuit 70.
Figure 8A:
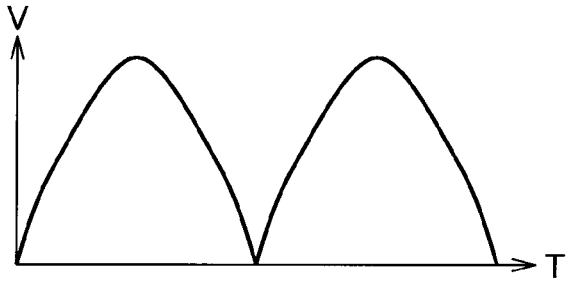
FIG. 8 is a diagram for explaining the operation of the LED drive circuit 70 shown in FIG. 7.
Figure 8B:
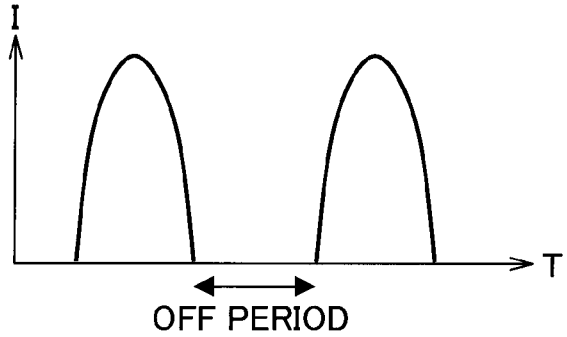
Figure 8C:
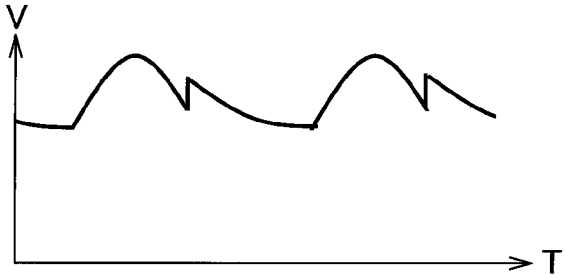
Figure 8D:
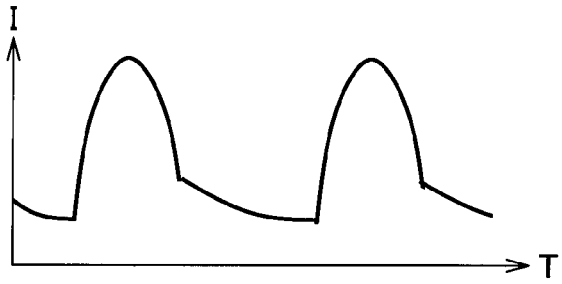

FIG. 7 is a circuit diagram of a still further alternative LED drive circuit 70.

The current supply circuit 2*d* in the LED drive circuit 70 includes an FET 72 (switch device: N-type MOS-FET) connected between one terminal of the capacitor 15 and the common line (the path through which the current returns to the diode bridge circuit 1). The current supply circuit 2*d* in the LED drive circuit 70 further includes a control circuit 71. The control circuit 71 monitors the drive voltage (at terminal C) being supplied to the light-emitting circuit 3*d*. When the voltage of the AC commercial power supply 11 begins to drop, the control circuit 71 sets the gate voltage (at terminal D) of the FET 72 to a low level (the voltage at the common line), and when the voltage of the AC commercial power supply 11 drops close to the threshold value of the diode array d, the control circuit 71 sets the gate voltage (at terminal D) of the FET 72 to a high level (the voltage at terminal C).

In the LED drive circuits 10, 30, and 50, when the voltage of the AC commercial power supply 11 begins to drop after peaking out, part of the charge stored on the capacitor 15 is discharged through the resistor 14 (or the current regulating diode 18). In contrast, in the LED drive circuit 70, the control circuit 71 controls the FET 72 so that, even when the voltage of the AC commercial power supply 11 begins to drop after peaking out, the capacitor 15 is not discharged until the voltage drops to a designated voltage (close to the threshold value of the LED array 4*d*). As a result, the charge stored on the capacitor 15 can be used effectively. The control circuit 71 that controls the gate voltage of the FET 72 according to the drive voltage (at terminal C) comprises a ladder resistor circuit, a comparator, a flip-flop for storing a state, etc.

FIG. 8 is a diagram for explaining the operation of the LED drive circuit 70.

FIG. 8(*a*) shows the drive voltage to the light-emitting circuit 3*d* when the LED drive circuit 70 is not equipped with the current supply circuit 2*d*; the drive voltage here is a pulsating DC which is the same as that shown in FIG. 2(*a*). FIG. 8(*b*) shows the current that flows through the light-emitting circuit 3*d* when the LED drive circuit 70 is not equipped with the current supply circuit 2*d*; the current here is a pulsating current having a narrow width which is the same as that shown in FIG. 2(*d*).

FIG. 8(*c*) shows the drive voltage to the light-emitting circuit 3*d* in the LED drive circuit 70. When the voltage of the AC commercial power supply 11 drops close to the threshold value of the LED array 4*d*, and the diode bridge circuit 1 is about to be cut off, the FET 62 turns on. At this time, the drive voltage increases for a while because the voltage across the capacitor 15 is equal to the peak voltage of the AC commercial power supply 11. After that, the capacitor 15 is discharged through the resistors 14 and 16 and the diode array 4*d*, so that a discharge curve appears on the drive voltage.

FIG. 8(*d*) shows the current that flows through the light-emitting circuit 3*d* in the LED drive circuit 70. When the voltage of the AC commercial power supply 11 drops and comes close to the threshold value of the LED array 4*d*, and the FET 72 turns on, the current increases for a while. Thereafter, the current gradually decreases until the voltage of the AC commercial power supply 11 again exceeds the threshold value of the LED array 4*d*. With the provision of the FET 72, the current supply circuit 2*d* in the LED drive circuit 70 allows a larger current to flow than the current supply circuit 2 in the LED drive circuit 10 does.

In the LED drive circuit 70, since the current rise when the FET 72 turns on is limited by the resistor 14, no substantial changes are observed in the current waveform, as illustrated in FIG. 8(*d*). Accordingly, in the LED drive circuit 70, no substantial changes occur in the current, and hence, harmonic noise does not occur.

In the LED drive circuit 70 also, the discharge time constant of the current supply circuit 2 is set longer than the charge time constant. The charge time constant is determined by the product of the internal resistance of the diode 13 and the capacitance of the capacitor 15. The discharge time constant is determined by the product of the resistance of the resistor 14 and the capacitance of the capacitor 15. Since the discharge of the capacitor 15 after the cutoff of the diode bridge circuit 1 is affected not only by the resistor 14 but also by the resistor 16 and the resistive component of the diode array 4, the resistance of the resistor 14 is appropriately determined by simulation or experiment. Further, since the current that flows when the diode bridge circuit 1 is cut off in the LED drive circuit 70 is smaller than the current that flows when the diode bridge circuit 1 is cut off in the LED drive circuit 10, the discharge time constant in the LED drive circuit 70 is set shorter than discharge time constant in the LED drive circuit 10.

As described above, in each of the LED drive circuits 10, 30, 50, and 70, during the period when the voltage of the AC commercial power supply 11 is not higher than the threshold value of the LED array 4 (or 4*a* or 4*d*), the LED array 4 (or 4*a* or 4*d*) is caused to emit light at a low intensity, thereby eliminating the OFF period while suppressing the generation of harmonic noise. Alternatively, each of the LED drive circuits 10, 30, 50, and 70 may be configured to increase the brightness and alleviate flicker and motion breaks by shortening the OFF period but not eliminating the OFF period completely.

What is claimed is:

1. An LED drive circuit comprising:

a rectifying circuit for rectifying AC commercial power;

a light-emitting circuit which includes an LED array; and a current supply circuit which includes a capacitor, a time constant adjusting element, and a diode;

wherein:

the discharge time constant of said current supply circuit is set longer than the charge time constant of said current supply circuit, and said capacitor is charged by an output of said rectifying circuit;

during a period of time when the magnitude of AC commercial power supply voltage is larger than the light emission threshold of said LED array, current to said light-emitting circuit is supplied mostly from said rectifying circuit, and during a period of time when the magnitude of AC commercial power supply voltage is not larger than the light emission threshold of said LED array, current to said light-emitting circuit is supplied from said current supply circuit;

an anode of said diode is connected to an output of said rectifying circuit and a cathode of said diode is connected to a high-voltage side terminal of said capacitor; and said time constant adjusting element and said diode are connected in parallel.

2. The LED drive circuit according to claim 1, wherein said time constant adjusting element is a resistor.

3. The LED drive circuit according to claim 1, wherein said time constant adjusting element is a current regulating diode.

4. The LED drive circuit according to claim 1, wherein said current supply circuit further includes a switch device connected in series with said capacitor.

5. The LED drive circuit according to claim 1, further comprising a control circuit which changes the number of stages to turn on in said LED array in accordance with said AC commercial power supply voltage.

6. The LED drive circuit according to claim 1, wherein said light-emitting circuit includes a current limiting circuit.

* * * * *